United States Patent [19]

Lundin et al.

[11] Patent Number: 4,923,374

[45] Date of Patent: May 8, 1990

[54] METHOD FOR PRODUCING PRESSURE PULSES IN A MASS OF GAS AND A DEVICE FOR PERFORMING THE METHOD

[75] Inventors: Stig Lundin; Birger Pettersson, both of Värmdö , Sweden

[73] Assignee: Svenska Rotor Maskiner AB, Stockholm, Sweden

[21] Appl. No.: 234,496

[22] PCT Filed: Nov. 25, 1987

[86] PCT No.: PCT/SE87/00559

§ 371 Date: Aug. 19, 1988

§ 102(e) Date: Aug. 19, 1988

[87] PCT Pub. No.: WO88/03995

PCT Pub. Date: Jun. 2, 1988

[30] Foreign Application Priority Data

Nov. 28, 1986 [SE] Sweden ..... 8605104

[51] Int. Cl.[5] ..... B08B 5/00; F04C 18/16; F04C 25/00; F28G 7/00

[52] U.S. Cl. ..... 417/440; 418/1; 418/201 B; 418/270; 15/404; 122/379; 134/31; 366/101; 366/106

[58] Field of Search ..... 418/1, 181, 201 R, 201 A, 418/201 B, 270; 122/379; 165/95; 134/18, 31, 37; 366/101, 106, 107, 108, 116, 124; 417/440, 543; 15/404

[56] References Cited

U.S. PATENT DOCUMENTS

| | | | |
|---|---|---|---|
| 1,443,764 | 1/1923 | Smith | 418/201 R |
| 2,351,163 | 6/1944 | Thomas | 122/379 |
| 2,473,234 | 6/1949 | Whitfield | 418/201 B |
| 2,474,653 | 6/1949 | Boestad | 418/201 R |
| 3,467,363 | 9/1969 | Reichel | 366/116 |
| 4,455,131 | 6/1984 | Werner-Larsen | 417/440 |
| 4,624,220 | 11/1986 | Olsson | 122/379 |
| 4,746,277 | 5/1988 | Glanvall | 418/181 |

FOREIGN PATENT DOCUMENTS

| | | | |
|---|---|---|---|
| 0006833 | 6/1979 | European Pat. Off. . | |
| 2521015 | 11/1976 | Fed. Rep. of Germany . | |
| 1158976 | 2/1958 | France | 418/181 |
| 54-30520 | 3/1979 | Japan | 418/201 R |
| 79/01019 | 11/1979 | PCT Int'l Appl. . | |
| 81/00064 | 1/1981 | PCT Int'l Appl. . | |
| 956960A | 9/1981 | Sweden . | |
| 80071509 | 10/1982 | Sweden . | |
| 445788 | 7/1986 | Sweden . | |
| 2033130A | 5/1980 | United Kingdom . | |

*Primary Examiner*—John J. Vrablik

*Attorney, Agent, or Firm*—Frishauf, Holtz, Goodman & Woodward

[57] ABSTRACT

A method for producing selectively controlled pressure pulses in a mass of gas, particularly contained in a space of large dimensions. To achieve a sufficiently high power in the pulses, the pulses are generated by a valveless displacement machine in which the pressure when the machine opens towards its outlet port differs from the pressure of the mass of gas. The pulse is generated as the working fluid, due to said pressure difference, flows at high velocity through the outlet port. An acoustic power of the generated pulses of up to 20 kW can be attained by the method. The invention also concerns a rotary displacement machine for performing the method.

23 Claims, 2 Drawing Sheets

METHOD FOR PRODUCING PRESSURE PULSES IN A MASS OF GAS AND A DEVICE FOR PERFORMING THE METHOD

BACKGROUND OF THE INVENTION

The present invention concerns a method for producing selectively controlled pressure pulses in a mass of gas, in particular contained in a space of large dimensions. By a mass of gas is here also included a mixture of gases e.g. air.

The invention also concerns a device for performing said method.

By generating pressure pulses in a mass of gas it undergoes a treatment raising the mechanical energy of the gas. The increased energy appears as potential energy in the form of local pressure fluctuations and as kinetic energy due to local speed variations in the mass of gas. The energy in the pulses oscillates between zero and a maximum, the two forms of energy being in phase with each other.

The energy of the pressure pulses can under certain conditions be used for different purposes such as preventing particles in the gas from settling on the walls of the space in which it is contained, as well as removing such particles already settled on said walls as a coating. The pulses can also be used for promoting the mixing of two different gaseous media, for mixing a gas with fluid droplets or solid particles and for other aspects of homogenizing a gas. The utilization of pressure pulses thus can be applied for cleaning purposes and in different stages in e.g. the process industry for treating gases that are going to be mixed, be combusted, react chemically, perform work etc. as well as treating media in the form of solid particles or fluid droplets suspended in a gas.

A condition for making such treatments of a mass of gas possible is that the pulses have a considerable acoustic power.

For the treatment of air in such applications as mentioned above the best results are achieved when the pulses are of a frequency near the lower limit of audible sound. At these low frequencies the pulses are not damped out to the same extent as at higher frequencies. Furthermore the long wave length enables the pulses to propagate around obstructing partitions reaching all the parts of the space concerned at uniform level of acoustic pressure.

Known methods for generating pressure pulses or sound waves in order to treat a mass of gas have not been able to produce pulses of enough energy for satisfactory utilizations of the kinds mentioned above when the gas is contained in a space of large dimensions.

The use of pressure pulses generated in a mass of gas has for example been applied for cleaning the walls of constructions containing gas. The absence of a pulse generator of sufficient efficiency, however, has limited the application to the cleaning of relatively small such constructions.

Examples of cleaning by use of sound pulses are disclosed in the Swedish patent application document 80 07 150-9 (with the publication No. 425 597) and in the British patent specification No. 2 033 130.

With the methods disclosed in said references, pulses having relatively high, but for many purposes still too low, energy are produced.

In the method disclosed in the Swedish patent document 80 07 150-9 the pressure difference between two spaces, periodically brought in communication with each other, is used, whereby the pulses are generated, as gas due to the pressure difference flows from one space to the other. The pulse generator includes a pipe for pressurized gas provided with a rotating cylindrical valve driven by an engine. The pipe and the valve, which are coaxially arranged, are each provided with a slot. As the slot of the valve during the rotation passes the slot of the pipe, communication is established between the pipe and the surrounding, whereby gas flows out through the aligned slots, generating a pulse. The pulses are then amplified in a resonance tube. The frequency is about 20 Hz. With this device a wave of substantially sinusodial shape is received, which results in an unfavourable distribution of energy during the pulse period. To maintain the pressure difference between the inside of the pipe and the surrounding a continuous supply of pressurized gas is necessary. The compressor required for the production of pressurized gas thus has to work all the time against the pressure in the gas pipe. This therefore requires a relatively high effective power input for the compression work in relation to the received acoustic power. A great part of this work is lost as heat. Furthermore, pulses are generated when compressing the gas. Due to the valve, these pulses do not leave the pipe, so that their energy is not made use of. Also this energy is lost as heat. The low acoustic efficiency of this method economically and practically limits the achievable output power.

Also with the sound generating device of the British patent specification 2 033 130 the sound pulses are generated by the flow of gas through an opening between two spaces of different pressure periodically brought in communication with each other. In this case the opening is controlled by a reciprocating slide connected to a membrane at the closed end of a resonance tube. In a starting position when the slide limits the opening to a narrow slot a soft low frequency sound is generated, affecting the membrane to oscillate at a frequency determined by the resonance tube. This forces the slide to reciprocate at the same frequency, closing and opening the valve opening, whereby the sound pressure in the resonance tube increases. This sound generator suffers from the same described drawbacks as the device of the Swedish patent document 80 07 150-9 does. An advantage, however, is received by the positive feed-back through the membrane securing harmony between the resonance frequency of the tube and the pulse frequency.

By the method disclosed in the referred British patent specification 2 033 130 an acoustic power of 1.5 kW at the highest is reached. It is intended to be used, as an alternative to soot blowing, for cleaning equipment in steam boiler plants such as superheater, heat exchanger, economizer and preheater. With the limited power output of the pulse generator this method can be used only for relatively small plants. For the cleaning of economizer and superheater in a boiler of more than 300 MW the power of the generated pulses is insufficient.

OBJECTS AND SUMMARY OF THE INVENTION

An object of the present invention is to attain a method for producing pressure pulses in a mass of gas. having a higher total acoustic power than can be reached by known methods.

According to the invention this has been achieved in that a method of the kind introductionally specified involves that the pulses are generated by a valveless displacement machine, in which the pressure when the machine opens towards its outlet port, differs from the pressure of the mass of gas.

Another object of the invention is to attain a device capable to produce pressure pulses of higher total acoustic power than can be reached by known pressure pulse generators.

According to the invention this has been achieved in that a device of the kind introductionally specified contains a valveless displacement machine generating the pulses and so constructed that the pressure in the machine, when it opens towards its outlet port, differs from the pressure of the mass of gas.

According to a preferred embodiment of the invention the machine works as a compressor and said pressure in the machine exceeds the pressure of the mass of gas. This results in an advantageous power relation between the received acoustic power and the power consumption of the machine.

In certain applications it can be better to construct the machine so that the pressure inside the machine is below the pressure of the mass of gas. This alternative, however, results in a somewhat lower value of the above specified power relation.

Further embodiments of the invention are specified in the dependent claims.

Like the methods of the above mentioned patent publications the method according to the invention makes use of the pressure difference between two spaces periodically brought in communication with each other, for the pulse generation.

As already mentioned the pulses of the known methods are sinusodial, but through the pulse generation according to the invention a very rapid flow through the communicating opening lasting only during a short initial stage of the pulse period is achieved. During the rest of the pulse period the flow through the opening is relatively slow. The strong concentration of the flow contributes in reaching a high acoustic power as the acoustic power in a wave is proportional to the integral of the square of the deviation in velocity from the mean velocity of the gas.

Another aspect of vital importance for the pulse generating method according to the invention is the fact that the pulses are generated directly by the means creating the pressure difference between the two spaces periodically brought in communication with each other. Due to this circumstance the energy consumption of the machine used according to the invention, when working as a compressor, is limited to the energy necessary for the compression work up to the moment of opening of the machine towards the outlet. The gas flown through the outlet in this moment rapidly equalizes the pressure difference between the working chamber of the compressor and the outlet. Since the pressure in the outlet channel normally is atmospheric no more work is required for displacing the rest of the gas in the working chamber. As no pressurized gas is produced, except the gas which for a short period is compressed in a working chamber and whose energy immediately is converted into acoustic energy, a considerable increase in the acoustic efficiency is attained.

Furthermore, as the pulses are generated directly by the flow of gas through the outlet of the machine, the acoustic energy that otherwise would have gone wasted in the pressure vessel is made use of.

The pulse generation according to the invention is based on a principle making possible a high power of the pulses. By the distinctive features of the invention this is carried through at a high efficiency and with accentuated energy variations during the pulse period. Thereby pulses can be produced having an acoustic power considerably higher than what up to now has been achieved. This makes possible the application of pressure pulse treatment of a mass of gas for the above-mentioned purposes to an extent that have not been practically possible with known techniques.

BRIEF DESCRIPTION OF THE DRAWINGS

The invention is further explained in the following detailed description of a preferred embodiment of the invention utilized in an application serving only as an illustration and with reference to the following drawings.

DETAILED DESCRIPTION

Figure 1:
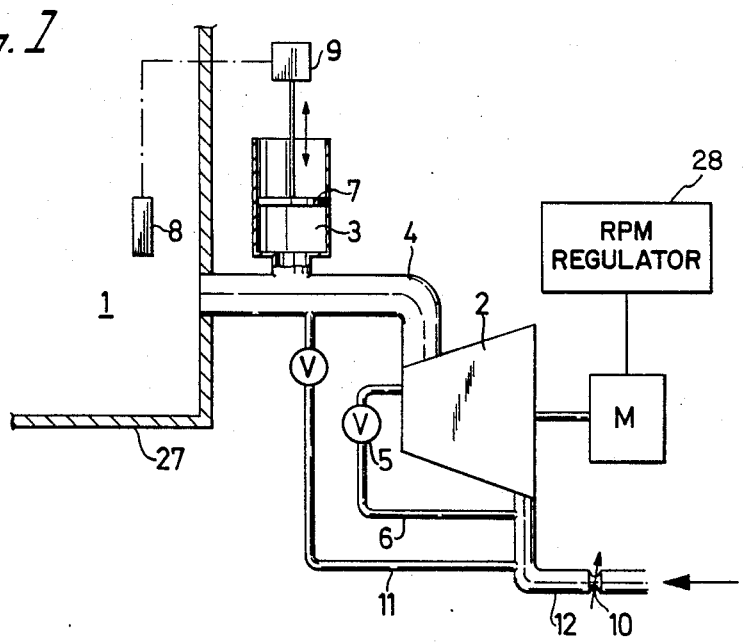
FIG. 1 shows a pulse producing device used for cleaning a steam boiler.

FIG. 1 shows a steam boiler 27, having inner surfaces on which a coating of soot and the like settles. A device including a pulse generator 2 according to the invention is connected to the steam boiler 27 through an air pipe 4. In the steam boiler 27 the pressure is some millibars below atmospheric pressure. Between the pulse generator 2 and the steam boiler 27 there is a resonator 3.

The pulse generator 2 is a screw compressor having meshing male 13 and female 14 rotors. As this kind of compressor is well known only a brief description of its working principle should be sufficient.

Figure 2:
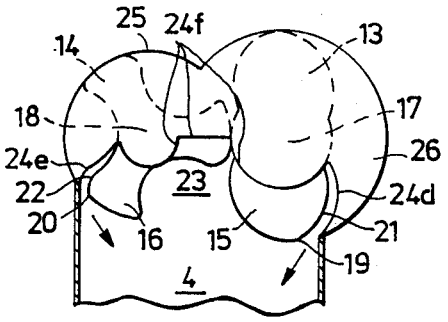
FIG. 2 shows an end view of the compressor in FIG. 3, omitting details not essential to the invention.
Figure 3:
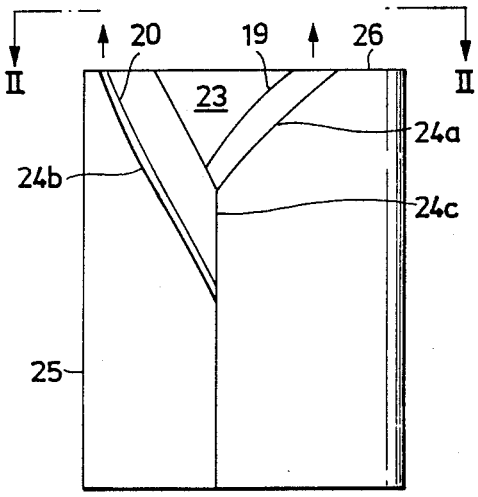
FIG. 3 shows a schematic view of a pulse generator working as a compressor.

In the compressor shown in FIGS. 2 and 3 the male rotor 13 has two helical lobes 15, mainly located outside the pitch circle of the rotor and having convex geometry. Between the lobes 15 two likewise helical grooves are formed. The female rotor 14 has in the corresponding manner three helical lobes 16 with intermediate grooves. The lobes 16 of the female rotor 14 are mainly located inside the pitch circle of the rotor and have flanks of concave geometry.

The lobes 15, 16 and the grooves of the rotors 13, 14 cooperate gearingly, forming chevron-shaped working chambers between the rotors 13, 14 and the surrounding barrel 25. The barrel 25 has the shape of two intersecting circular cylinders, each housing one of the rotors 13, 14. During rotation, the working chambers travel axially from one end of the machine 2, having an inlet, to the other end, having an outlet.

Each chamber is during a filling stage in communication only with the inlet, when air is sucked into the chamber, during a compression stage closed off from both the inlet and the outlet, when air is transported towards the outlet while being compressed and during a discharge stage in communication only with the outlet when air leaves the chamber.

The compressor 2 is made to work with overcompression, i.e. it compresses the air in a working chamber to a pressure level exceeding the pressure in the outlet channel 4. The overpressure is moderate, about 0.3 to 1 bars. When communication is opened towards the outlet, air flows at a high velocity from the working chamber, where overpressure prevails out through the outlet port 23 to the outlet channel 4, where the pressure is nearly atmospheric. The rapid outflow results from the pressure difference and occurs only during a short period at the beginning of the discharge of a chamber, whereby a very powerful pressure pulse is generated. Thereafter the pressure on both sides of the outlet port 23 is principally equalized and the discharge is effected only by the displacing of the air as the volume of the working chamber continuously decreases. The flow velocity thus variates strongly during the pulse period.

Figure 4:
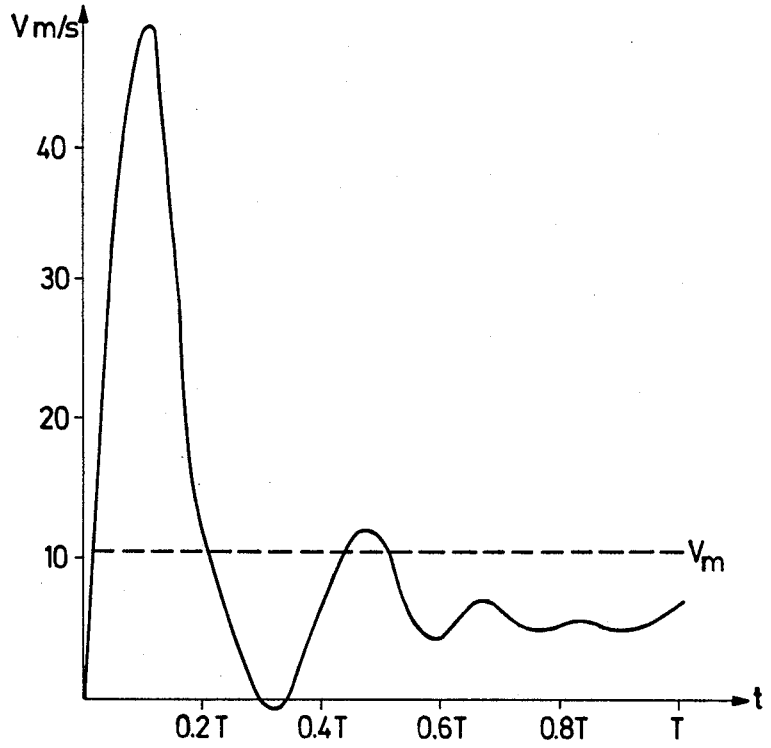
FIG. 4 diagrammatically shows the air velocity through the outlet port of the compressor during the discharge.

In FIG. 4 the flow velocity of the air through the outlet port during the discharge of a working chamber diagramatically is shown. The powerful pressure pulse is attained at the initial phase of the discharge. Thereafter the outflow takes place at considerably lower velocity. The lower velocity level is not steady but fluctuates somewhat as a consequence of the high velocity at the initial phase.

The momentary content of energy in a wave movement is proportional to the square of the deviation of the momentary velocity from the mean velocity. The concentration of the acoustic energy to a short pulse during the wave period thus is still more accentuated than the course of the velocity. This results in a considerably higher power outcome than normally can be reached with a pure sinusodial wave shape.

In the process illustrated in the diagram the pulse frequency is 20 Hz. The t-coordinate T thus represents 0.05 seconds. The compressor works with an overpressure of 0.32 bars at the moment of the opening of the chamber towards the outlet.

The outlet port 23 is radially as well as axially directed. The radially directed part of the port 23 is defined by three edge sections 24*a, b, c*. A first edge section 24*a* extends obliquely outwards over the barrel half housing the male rotor 13 from a point on the barrel 25 where the two barrel halves intersect and reaches the high pressure end wall 26. A second edge section 24*b* likewise extends obliquely outwards over the barrel half housing the female rotor 14 from a point on the barrel 25 where the two barrel halves intersect but located closer to the inlet end than said first point and reaches the high pressure end wall 26. A third edge section 24*c*, colinear with the barrel intersection line, connects said two points.

The axially directed part of the port 23 is defined by three edge sections 24*d, e, f*. A first edge section 24*d* extends curvilinearly inwards from a point on the outer edge of the end wall 26 where the first edge section 24*a* of the radially directed part of the port 23 ends, and reaches radially the carrying body 17 of the male rotor 13. A second edge section 24*e* extends curvilinearely inwards from a point on the outer edge of the end wall 26 where the second edge section 24*b* of the radially directed part of the port 23 ends, and reaches radially the carrying body 18 of the female rotor 14. A third edge section 24*f* connects the inner ends of said first 24*d* and second 24*e* edge sections.

For attaining maximal power of the generated pulses the lobes 15, 16 of the rotors are shaped with a sharp edge 19, 20 at the periphery so as to open momentary. By the same reason the edge sections 24*a, b, d, e* of the outlet port are shaped to be parallel to the corresponding edges 19, 20, 21, 22 of the lobes 15, 16 at the moment of opening.

The inflow and outflow of air are controlled by the cooperation of the lobes 15, 16 with the ports. Thus, communication is opened between a working chamber and the outlet channel 4 at the moment the tip edges 19, 20 of the lobes 15, 16 located advanced to said chamber and the end edges 21, 22 at the rear side of said lobes pass the corresponding edge sections 24*a, b, d, e* of the outlet port 23. No valves are therefore necessary for controlling the inflow and outflow of air.

At the moment when communication just has been opened between the inside of the machine 2 and the outlet channel 4, as shown in FIGS. 2 and 3, air flows out radially through the slots created between the edge section 24*a* of the outlet port 23 and the tip edge 19 of the male rotor lobe 15 and between the edge section 24*b* of the outlet port and the tip edge 20 of the female rotor lobe 16 and axially through the slots created between the edge section 24*d* of the outlet port and the rear end edge 21 of the male rotor lobe 15 and between the edge section 24*e* of the outlet port and the rear end edge 22 of the female rotor lobe 16.

In the preferred embodiment a lobe combination of few lobes has been chosen. This allows a large air volume in each working chamber and also results in that the total length of the edge sections 24*a, b, d, e* of the outlet port 23 cooperating with the lobes can be made great. A great edge length leads to an advantageous opening performance since maximal flow at the moment of opening is strived at in order to concentrate the pulse. The faster the tip speed of the rotors 13, 14, the quicker the opening takes place, and at a given pulse frequency the tip speed is higher with fewer lobes. The rotors 13, 14 have unequal number of lobes 15, 16 so that both of them open simultaneously towards the outlet. Thereby a low frequency in relation to the rpm is achieved and additionally as large air volume per pulse as possible is attained. The rpm of the compressor 2 is chosen so that the pulse frequency is in the range between 10 and 50 Hz with a preferred value of about 20 Hz. The pulses so generated can reach an acoustic power of up to 20 kW.

The pressure pulses propagate through a pipe system, comprising the channel 4 and the resonator 3, into the steam boiler 27 (FIG. 1). The resonator 3, located between the compressor 2 and the steam boiler 27 amplifies the fundamental tone of the pulses generated by the compressor 2. The length of the resonator 3 is matched to give the mass of air in the system a resonance frequency harmonizing the frequency of the pulses i.e. 20 Hz.

For removing the soot coating on the walls of the steam boiler 27 it is not necessary that the pulse generator works continuously. On the other hand the intervals between each work period must not be too extended as the thickness of the coating then can be so great that it will affect the operating economy of the steam boiler negatively. Work periods of 30 seconds with intervals of 10 minutes would in many cases be an appropriate cycle. With such relatively short intervals between the work periods it would not be advisable to stop the compressor during the rest periods. The great number of starts would then lead to too much wear on the compressor aggregate.

In order to allow continuous running of the compressor 2 it is provided with air releasing means 5, 6. From a closed working chamber a return channel 6 provided with a shut off valve 5 leads to the compressor inlet. By the opening of the shut off valve 5 the pressure in the working chamber is equalized to atmospheric pressure releasing the compressor 2. As the compressor 2 during the rest periods thus is idling the energy consumption will be negligible.

Maximal intensity of the pulses on the walls of the steam boiler 27 is attained when the pulse frequency corresponds to the resonance frequency of the air in the pipe system transmitting the pulses to the steam boiler 27.

This can be achieved in principal in two different manners. Either by modifying the pulse frequency to harmonize the resonance frequency of the system or by modifying the resonance frequency to harmonize the pulse frequency. In the first manner steering towards resonance can be effectuated by regulating the rpm of the compressor 2 by rpm-regulating means 28.

In the embodiment shown in FIG. 1 steering is effectuated by affecting the resonance frequency of the resonator 3. To this end the resonator 3 is provided with an end wall 7, displaceable from a reference position. The resonator 3 is dimensioned to give the air in the system a resonance frequency roughly corresponding to the pulse frequency i.e. 20 Hz at a certain temperature and with the end wall 7 in its reference position. At operation the end wall 7 is adjusted to a position where precise resonance occurs. In this manner compensation can be made for deviations in the temperature of the incoming air and for other parameters possibly affecting the resonance frequency of the system. The displaceable end wall 7 also offers a possibility to run the compressor 2 at another rpm as the position of the end wall 7 can be matched to the changed pulse frequency.

The position of the end wall 7 can be governed by measuring the intensity of the pulses with sensor means 8 e.g. at a point inside the steam boiler 27, and then displacing the end wall 7 to the position where maximal intensity is measured. This can preferably be automated by the use of a micro-processor 9. With the displaceable end wall 7 it is also possible to steer the pulse intensity in the steam boiler 27 to a level deviating from the maximal, which is a need that in certain cases can be present.

Regulation of the amplification by a displaceable end wall in the resonator can be replaced or supplemented by measures for affecting the temperature of the air in the system. As the wave length is proportional to sound velocity and the latter is proportional to the square root of the absolute temperature, a change of temperature will change the resonance frequency of the system. Regulation of the temperature can be carried out in many ways: By a variable restriction in the inlet channel 12 of the compressor 2, by providing the compressor 2 with a slide valve regulating the internal compression rate of the compressor or by returning air from the compressor outlet channel 4 or a closed working chamber to its inlet. Also the regulation of the temperature can be governed by signals from the sound intensity sensor 8.

As an alternative to a separate resonator or supplementing it, the mass of gas 1 in the steam boiler 27 can itself be used as a resonator, whereby the pulse frequency is regulated to match the resonance frequency of the mass of gas 1. It is also possible to utilize the pulses without any kind of resonance amplification.

A return channel 11 for air from the outlet channel 4 to the inlet can be necessary also in order to avoid pumping of a great amount of relatively cold air into the steam boiler 27. As the pressure in the steam boiler 27 is somewhat below atmospheric pressure, this might require a moderate throttling (about 1 millibar) of the inlet air at a point upstream to the inflow of the returned air.

In the described and in the figures illustrated embodiment the pulses are generated by a compressor in which the air in a working chamber has been compressed to a certain over-pressure before being discharged through the outlet port. This gives an advantageous operating economy considering the energy consumption.

In an alternative embodiment, not shown, the pulses are generated at an opposite direction of flow of the air through the outlet port. This is effectuated by a displacement machine, which pumps the air without compressing it, e.g. a Root type blower or a screw compressor without internal compression. In this embodiment it is necessary to throttle the air in the inlet channel of the machine to about 0.5 bars or less. This pressure will be maintained until the working chamber opens towards the outlet. At this moment air of substantially atmospheric pressure flows from the outlet channel at high velocity through the outlet port into the working chamber where subatmospheric pressure prevails, thereby generating the powerful pressure pulse. As the volume of the working chamber then continuously decreases the air is pressed back into the outlet channel.

This alternative embodiment demands a higher power consumption than the one earlier described. This power is to a large extent lost as heat. A less amount of air is pumped into the boiler and the air has a higher temperature.

In the illustrated embodiment a certain operation cycle was specified. This cycle can of course be varied in respect of the length of the work and rest periods. The operation cycle can also be such that the rpm of the machine alters between two work periods, in order to attain a pulse frequency altering between two different values. Also when the machine is continuously working the pulse generator can operate with altering frequency.

When working with altering frequencies it is advisable to correspondingly affect the resonance frequency of the system e.g. by displacing the end wall 7 of the resonator 3 between two discrete positions, if maximal amplification is desired during the complete cycle.

Figure 5:
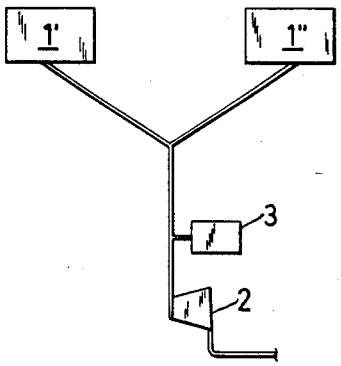
FIG. 5 shows an embodiment in which the pulses are distributed to two separate masses of gas.

The illustrated device is not restricted to clean only one single space of a steam boiler plant. By providing the channel system with a branched channel, as shown in FIG. 5, the pulses can be transmitted to two or more separate spaces 1', 1''. Cleaning of separate spaces thereby can be effected simultaneously or alternating, in the latter case by use of flow altering means provided in the branch.

We claim:

1. A method for producing selectively controlled pressure pulses in a mass of gas, the pulse energy of which is to be made use of, comprising:

generating pulses by a valveless rotary displacement machine, the machine including a casing having an inlet port and an outlet port, and at least one rotor rotatably mounted in said casing;

communicating said outlet port with said mass of gas;

forming gas chambers in said casing by rotation of said rotor;

filling each gas chamber with gas during a filling phase during which respective gas chambers are in communication with said inlet port;

discharging gas from said gas chambers during a discharge phase when said gas chambers are in communication with said outlet port;

causing said discharge phase and the resultant generation of pulses to occur at a frequency in the range of from 10 to 50 Hz; and causing the pressure in said each gas chamber, when it starts to communicate with said outlet port, to differ from the pressure in said mass of gas, to thereby produce a controlled pressure pulse.

2. The method of claim 1, wherein said at least one rotor is provided with a carrying body having projecting portions extending therefrom, said projecting portions forming interspaces between each other, and said projecting portions cooperating with an edge of the outlet port to determine the moment of communication between a gas chamber constituted by an interspace behind, as seen in the direction of rotation of said at least one rotor, a projecting portion and said mass of gas.

3. The method of claim 2, wherein said machine includes two rotors, and further comprising gearingly cooperatively coupling said two rotors to each other through said projecting portions and said interspaces.

4. The method of claim 3, wherein said two rotors have dissimilar profiles in a plane substantially perpendicular to their axes of rotation for simultaneously opening of a gas chamber in each rotor towards said outlet port.

5. The method of claim 4, wherein said machine operates as a compressor, and the pressure in said machine, when it opens towards its outlet port, exceeds the pressure of said mass of gas.

6. The method of claim 3, wherein said rotors have an unequal number of projecting portions, the number of projecting portions of one of said rotors being three or less, and further comprising driving the machine to control a frequency of the generated pressure pulses to be about 20 Hz.

7. The method of claim 2, comprising selectively controlling the frequency of said generated pressure pulses by regulating the rpm of the machine.

8. The method of claim 7, comprising controlling the frequency of said generated pressure pulses to a value corresponding to a resonance frequency of said mass of gas.

9. The method of claim 1, further comprising controlling the temperature of the working fluid of the machine.

10. The method of any one of claims 1 to 9, wherein said pressure pulses are produced under amplification of a fundamental tone of the generated pulses by a resonator, and comprising mutually adapting the resonance frequency of the resonator and the frequency of said pressure pulses.

11. The method of claim 10, comprising measuring the intensity of the amplified pulses; and adapting the resonance frequency of said resonator and the frequency of said pressure pulses responsive to said measured intensity.

12. The method of claim 4, comprising:

communicating said outlet port of said machine with said mass of gas through an outlet channel;

communicating said inlet port with an inlet channel; and returning working fluid from said outlet channel to said inlet channel.

13. The method of claim 1, comprising using said pressure pulses generated by the machine for establishing pressure pulses in at least two separate masses of gas by connecting said outlet port of the machine to each of said separate masses of gas.

14. The method of claim 1, wherein said pressure pulses are generated during work periods separated by rest periods, and further comprising continuously keeping a pressure equalizing communication between the gas chambers of the machine and its inlet channel during said rest periods, to thereby release pressure in the machine during said rest periods.

15. An apparatus for producing and selectively controlling pressure pulses in a mass of gas, the pulse energy of which is to be made use of, comprising:

a valveless rotary displacement machine for generating said pressure pulses, the machine including a casing having an inlet port and an outlet port, said outlet port communicating with said mass of gas, and at least one rotor rotating in said casing for forming gas chambers;

means for communicating each chamber, during a filling phase, with said inlet port, and during a discharge phase, for communicating each chamber with said outlet port;

means for causing said discharge phase to occur at a frequency in the range of from 10 to 50 Hz; and means for causing the pressure in said each gas chamber, when it starts to communicate with said outlet port, to differ from the pressure in said mass of gas, to thereby produce a controlled pressure pulse.

16. The device of claim 15, wherein said at least one rotor comprises a carrying body having projecting portions extending therefrom, said projecting portions forming interspaces between each other, and said projecting portions by cooperation with an edge of said outlet port determining the moment of communication between a gas chamber constituted by an interspace behind, as seen in the direction of rotation, a projecting portion and said mass of gas.

17. The device of claim 16, wherein the machine includes two rotors gearingly cooperating through said projecting portions and said interspaces.

18. The device of claim 17, wherein said two rotors have dissimilar profiles in a plane substantially perpendicular to their axes of rotation for the simultaneous opening of a gas chamber in each rotor towards said outlet port.

19. The device of claim 18, wherein said projecting portions are helically twisted along said rotors.

20. The device of claim 16, wherein said projecting portions have sharp edges, and wherein a part of an edge of said outlet port determining the moment of communication in each section is parallel to said sharp edges of said projecting portions which cooperate with said each section.

21. The device of claim 18, wherein said rotors have an unequal number of projecting portions, the number of projecting portions of one of said rotors being three or less; and wherein the machine includes means for regulating the rpm of the rotors.

22. The device of claim 21, further comprising a resonator dimensioned to amplify a fundamental tone of generated pulses.

23. The device of claim 15, further comprising a resonator dimensioned to amplify a fundamental tone of generated pulses.

* * * * *